US007735502B1

(12) United States Patent
Hotes

(10) Patent No.: US 7,735,502 B1
(45) Date of Patent: Jun. 15, 2010

(54) COMPACT, ALL-WEATHER TEMPORARY SHELTER

(76) Inventor: Douglas T. Hotes, P.O. Box 2459, Kirkland, WA (US) 98083-2459

( * ) Notice: Subject to any disclaimer, the term of this patent is extended or adjusted under 35 U.S.C. 154(b) by 568 days.

(21) Appl. No.: 11/473,653

(22) Filed: Jun. 22, 2006

Related U.S. Application Data

(60) Provisional application No. 60/800,064, filed on May 12, 2006.

(51) Int. Cl.
*E04H 15/10* (2006.01)
*E04B 1/32* (2006.01)

(52) U.S. Cl. ..... 135/91; 135/93; 135/136; 135/906; 52/86; 52/63

(58) Field of Classification Search ..... 135/91–94, 135/121–124, 137, 115, 118, 119, 157, 160, 135/906–907, 87, 136; 52/2.22, 2.24, 2.25, 52/63, 86, 83
See application file for complete search history.

(56) References Cited

U.S. PATENT DOCUMENTS

| | | | | | |
|---|---|---|---|---|---|
| 491,288 | A | * | 2/1893 | De Lastelle | 52/644 |
| 659,981 | A | | 10/1900 | McCall | |
| 2,666,507 | A | * | 1/1954 | Ruark | 52/643 |
| 2,797,696 | A | | 7/1957 | Fritsche | 135/1 |
| 2,806,477 | A | | 9/1957 | Fritsche | 135/4 |
| 3,233,617 | A | * | 2/1966 | Stern | 135/158 |
| 3,256,896 | A | | 6/1966 | Cummins | 135/4 |
| 3,480,023 | A | | 11/1969 | Mcconnell et al. | 135/1 |
| 3,670,747 | A | * | 6/1972 | Pohl et al. | 135/94 |
| 3,749,107 | A | * | 7/1973 | Laberge | 135/137 |
| 3,930,344 | A | | 1/1976 | Gahler | 52/2 |
| 3,968,604 | A | * | 7/1976 | Hills | 52/86 |
| 4,102,352 | A | * | 7/1978 | Kirkham | 135/97 |
| 4,222,401 | A | | 9/1980 | Allweil | 135/1 |
| 4,231,289 | A | * | 11/1980 | Domicent | 454/52 |
| 4,244,384 | A | | 1/1981 | Bean | 135/4 |
| 4,567,696 | A | * | 2/1986 | Malet | 52/2.25 |

(Continued)

FOREIGN PATENT DOCUMENTS

GB 2123866 A * 2/1984

*Primary Examiner*—Winnie Yip
(74) *Attorney, Agent, or Firm*—Dean A. Craine

(57) ABSTRACT

A compact, temporary shelter that includes at least two vertical frame members aligned transversely over a base frame. Each frame member includes two opposite straight lower sections, two curved eave sections, two optional straight roof sections and a curved, central peak section. Adjacent frame members are interconnected by a plurality of purlins. The shelter includes an inner liner disposed over the inside surfaces of the frame members. The inner liner creates wall air spaces between two adjacent frame members and an upper attic and a lower living space that are partially isolated. When attached to an HVAC unit, air from the living space and flows and circulates into the wall air spaces between the frame members and into the attic. From the attic, air travels through a vent opening formed on an end cover to the outside environment. Located inside the shelter is a flexible air sock that connects at one end to the output port on the HVAC unit to evenly distribute the air into the living space. Because the frame member includes straight sidewalls and the inner lining forms a relatively high ceiling, greater storage and living space is created.

15 Claims, 15 Drawing Sheets

U.S. PATENT DOCUMENTS 4,649,947 A 3/1987 Tury et al. ..... 135/97
4,707,953 A * 11/1987 Anderson et al. ..... 52/63
4,802,500 A 2/1989 Davis ..... 135/97
5,107,881 A * 4/1992 Feldman et al. ..... 135/124
5,245,802 A 9/1993 Davis ..... 52/86
5,421,355 A * 6/1995 Cantwell ..... 135/120.3
6,502,593 B1 * 1/2003 Stafford ..... 135/115
6,505,638 B1 * 1/2003 Powell et al. ..... 135/124
6,679,009 B2 1/2004 Hotes ..... 52/86

* cited by examiner

COMPACT, ALL-WEATHER TEMPORARY SHELTER

This is a utility patent application claiming the priority to the provisional patent application (Ser. No. 60/800,064) filed on May 12, 2006.

BACKGROUND OF THE INVENTION

1. Field of the Invention

This invention pertains to the field of temporary shelters and, more particularly, to all-weather temporary shelters that can be stored in a compact configuration in a single container and then easily and quickly assembled.

2. Description of the Related Art

Portable shelters are commonly used by the U.S. military for temporarily housing military personnel, equipment, and supplies. Ideally, such shelters should be stored in a compact configuration for easy transportation, and should be relatively quick and easy to assemble and disassemble with hand tools.

For military use, portable shelters must be designed for use in both hot and cold external environments. In order to be used in these different environments, the roof and side walls used on the shelters should form enclosed, sealed structures that can be cooled or heated with portable HVAC units. Assembled inside the shelter should be duct work that transports the cool or hot air from the HVAC throughout the shelter.

Temporary shelters used in the prior art typically include a plurality of arched frame members that are evenly spaced apart and connected at their opposite ends to a rectangular-shaped lower base frame that attaches to the ground. A flexible roof cover is then pulled over the frame members to form an elongated, half-circular structure. An example of such a shelter is shown and described in U.S. Pat. No. 6,679,009. One drawback with such shelters is that the arch frame member has relatively short side walls that prohibits tall objects from being stored adjacent to them. As a result, a significantly large amount of storage space is wasted and not used when tall objects are placed inside the shelter.

Another drawback with temporary shelters with flexible roof covers used in the prior art is that the outside cold or hot temperatures are transmitted through the roof cover and into the shelter. Also, the air inside these shelters is not adequately exchanged thereby creating different temperature zones inside the shelter.

SUMMARY OF THE INVENTION

It is an object of the present invention to provide a compact, all-weather, temporary shelter.

It is an object of the present invention to provide such a shelter that is designed for relatively quick and easy assembly and disassembly using common hand tools.

It is another object of the present invention to provide such a shelter that includes straight side walls with a high ceiling for maximum storage space.

It is a further object of the present invention that includes an improved air duct and a air circulation system that can be used with a portable HVAC unit.

These and other objects of the invention which will become apparent are met by a compact all-weather, temporary shelter disclosed herein that comprises a lightweight, easy-to-assemble frame covered with a durable, main cover. The frame includes a plurality of transverse frame members attached at their lower ends to a rigid base frame that is attached to the ground. Each frame member includes two opposite straight lower sections, two curved eave sections, two optional straight roof sections and a central peak section. Adjacent frame members are interconnected by a plurality of purlins that extend longitudinally on the shelter. The individual components used on the base frame and on each frame member are designed to snap-fit together and held together with removable pins, thereby eliminating the need for tools.

After the frame is assembled and attached to the base frame, a flexible main cover is extended over the frame and held in place over the frame with cables, quick-release connectors and cleats are attached to the base frame which the cables engage to hold the main cover in place. Disposed over each end opening is a flexible end cover. The lateral edges of the main outer cover overlap the upper edges of the two end covers, thereby creating a wind-tight enclosure. Cables, quick-release connectors and cleats are also used to hold the end cover's in place.

The shelter includes an adjustable, modular lightweight inner liner disposed over the entire length and width of the frame. In the preferred embodiment, the main cover and inner liner are attached to the outside and inside surfaces of the frame members, respectively. The frame members are rectangular in cross-section thereby creating an intermediate wall air space between two adjacent frame members when the main cover and inner liner is attached. An optional gap or vent is created along the lower edge of the inner liner near the floor which allows air from the central area of the shelter to flow along the floor and circulate into the wall air space. The inner liner is sufficient in length to extend transversely over the shelter. In the preferred embodiment, the inner liner is made of a plurality of liner panels that extends horizontally across the center region of the shelter. Each liner panel is suspended from guide lines that connect at their upper ends to the frame members, located above the inner liner, thereby creating a relatively large, longitudinally aligned attic inside the shelter between the main cover and the inner lining. When all of the liners are attached, the attic extends the entire length of the shelter between the main cover and the inner lining, and above the main living area. Air located along the floor is able to flow into the wall air spaces and flow into the attic.

As stated above, disposed over the end openings of the shelter are two flexible end covers. Formed on at least one end cover is a door opening with a flexible flap cover and an optional window opening and flexible window covering. Also formed on at least one end cover, are two HVAC unit port openings that connect to the inlet and outlet ports on a HVAC unit located outside the shelter. Also near the peak of each end cover and adjacent to the attic is a closeable vent. During warm or hot outdoor conditions the vent is opened to allow air to flow from the attic to the outside environment.

Located inside the shelter is a flexible air sock that connects at one end to the output port on the HVAC unit. The air sock is a flexible tube that lays flat in a stored position and forms a cylindrical structure when filled with air. The air sock connects at one end to the HVAC port and extends upward along the end cover and then longitudinally and horizontally inside the shelter just below the inner lining. Because the main section of the inner lining extends horizontally, it forms a relatively high ceiling inside the shelter, and the air sock may expand and extend downward from the inner lining and not interfere with the shelter's main living space. A plurality of vents are formed along the air sock through which air from the HVAC unit can be evenly dispersed inside the main living space. When the HVAC unit is activated, positive pressure is created inside the shelter which causes inside cool air delivered from the HVAC unit to travel along the floor of the shelter, upward through the wall spaces and into the attic. The warm air in the attic then flows to the outside through the vent formed on the end cover.

The above described shelter has straight side walls that not only increases the useable space inside the shelter, but also creates a sufficiently high ceiling which enables individuals to stand upright and move comfortably in the shelter's main living space. The use of lightweight, relatively thin frame members covered by an outer cover and an inner lining creates an intermediate wall air space that surrounds and insulates the main living space. Because the air circulates in the wall air spaces and into a relatively large attic that is isolated from the main living space, the temperature of the main living space is easy to maintain. Also, because the ceiling is relatively high, an air sock may be used to more evenly dispense air from the HVAC unit located at one end of the shelter.

DESCRIPTION OF THE PREFERRED EMBODIMENT(S)

Figure 1:
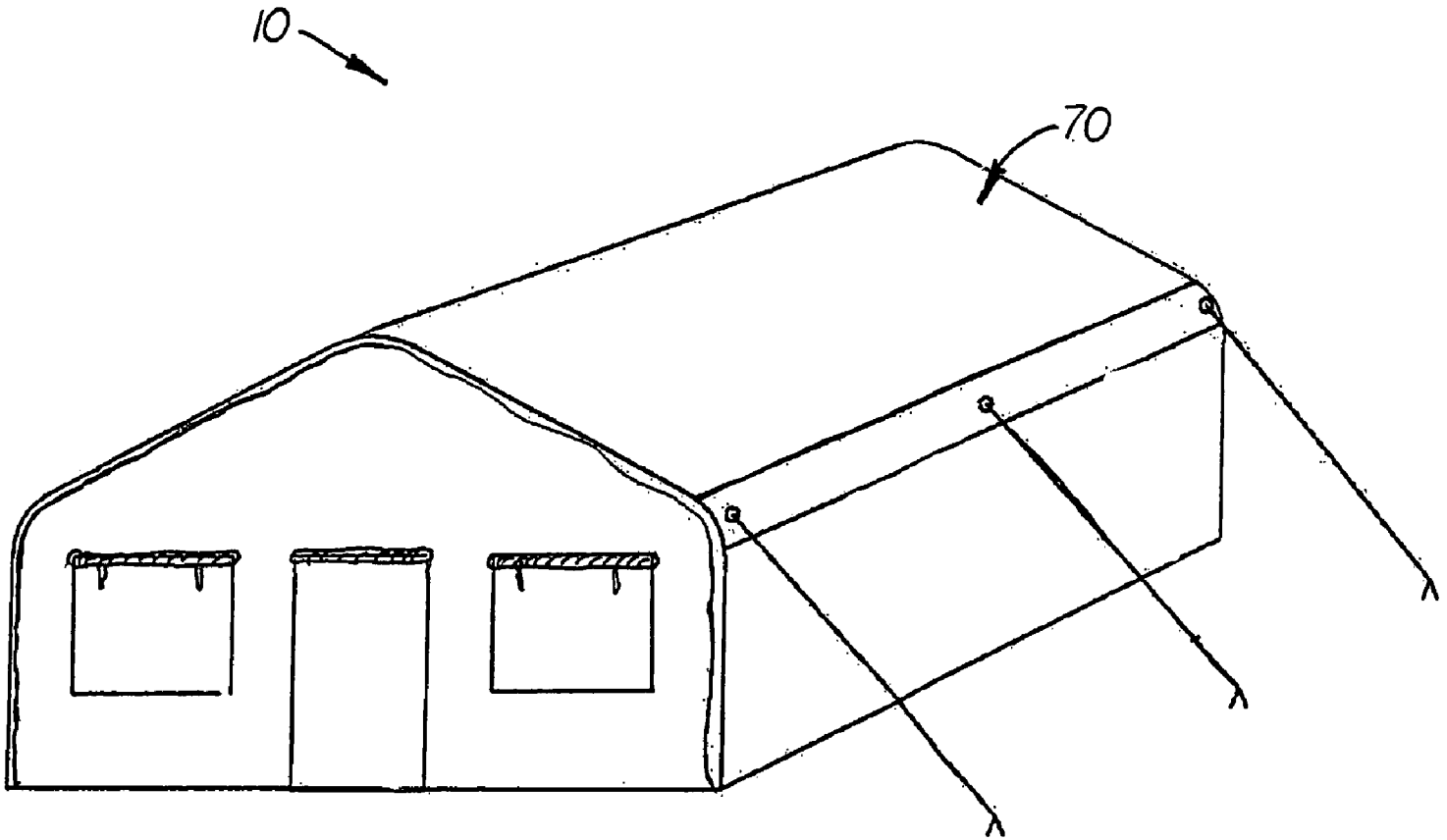
FIG. 1 is a perspective view of an assembled compact, all-weather temporary shelter disclosed herein.

Referring to the accompanying Figs., there is shown and described a compact, all-weather temporary shelter 10 comprising a lightweight, easy-to-assemble frame 12 covered with a durable, main cover 70. The frame 12 includes a plurality of transversely aligned frame members 40 attached at its lower ends to a square or rectangular base frame 33 that attaches to the ground. Each frame member 40 includes two lower straight section members 42, 42', two curved eave sections 44, 44', two optional straight roof sections 48, 48' and a central peak section 49. Adjacent frame members 40 are interconnected by one or more purlins 60. The sections 42, 42', 44, 44', 48, 48' and 49 are designed to slide together and held together with optional removable pins, similar to the components disclosed in U.S. Pat. No. 6,679,009, which is hereby incorporated herein by reference.

Figure 2:
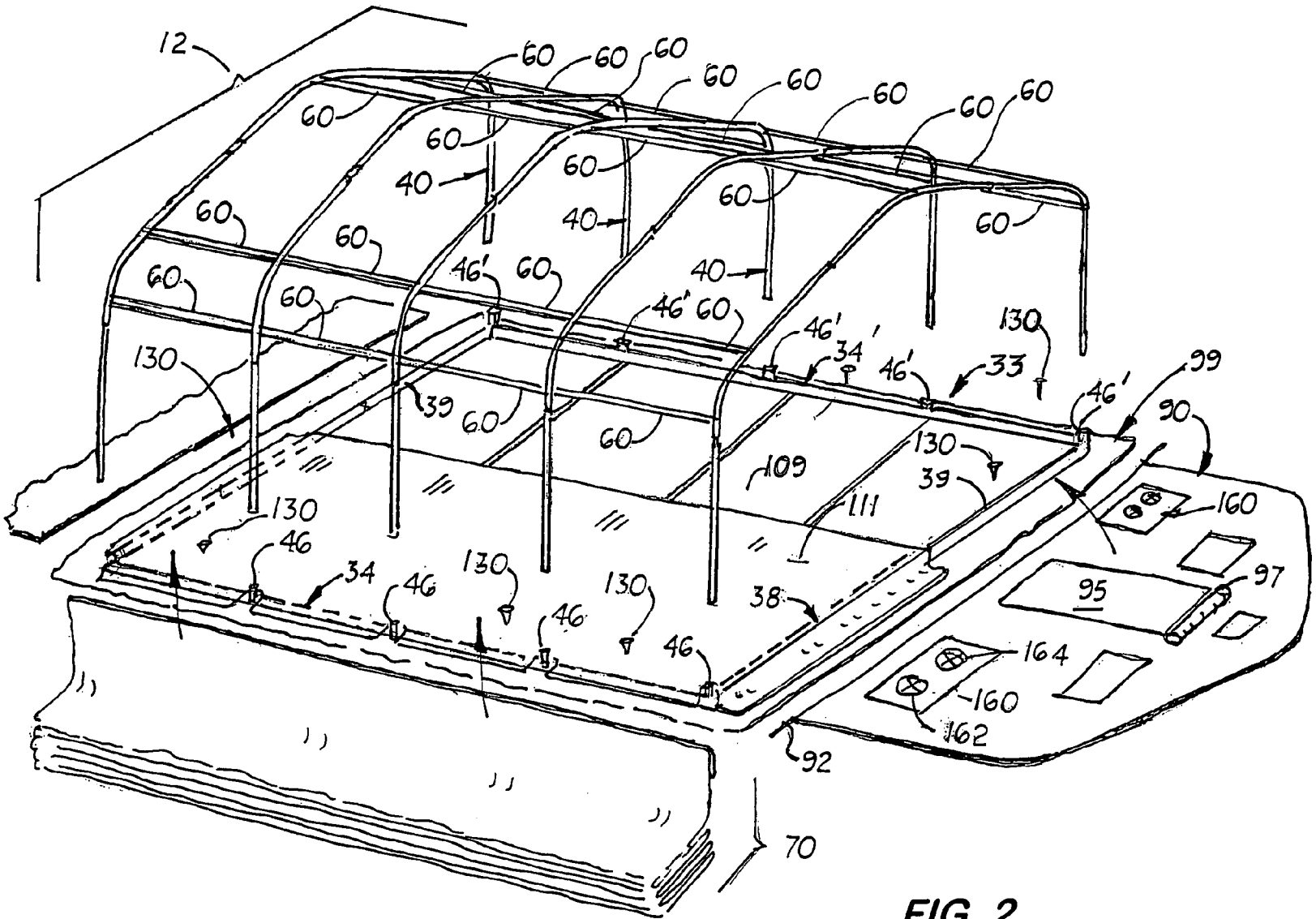
FIG. 2 is a partially exploded perspective view of the base frame, the frame, the outer cover located in a folded position adjacent to the base frame and two unfolded end covers.
Figure 3:
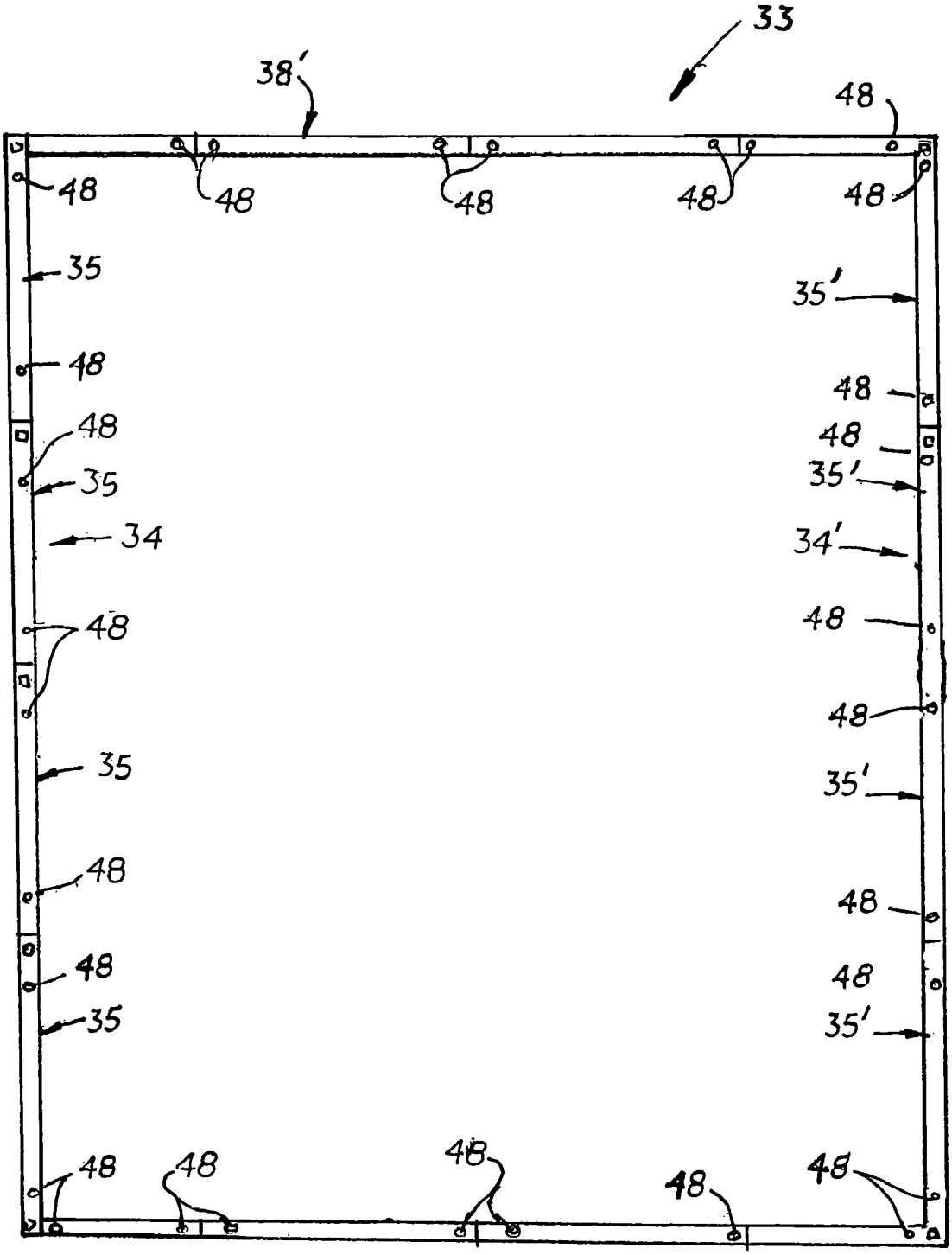
FIG. 3 is a top plan view of the base frame.

As shown more clearly in FIGS. 2 and 3, the overall shape of the base frame 33 is a square or rectangular and comprises two side base members 34, 34' and two end base members 38, 38'. In the preferred embodiment, the two side base members 34, 34' are made of a plurality of straight members 35, 35' also designed to slide together. The straight members 35, 35' include two opposite open ends each with an insert member 37 formed or attached thereto (one shown). The straight members 35, 35' are designed to be longitudinally aligned and connected together. On the straight members 35, 35', a perpendicularly aligned stub 46, 46', respectively, is formed near one end which is designed to slide into the lower open end on the straight section 42, 42' on a frame member 40.

Each end base member 38, 38' is made of a plurality of longitudinally aligned straight members 39, 39' similar to the straight members 35, 35' discussed above. Each straight member 39, 39' has either two opposite open ends 36 or one open end 36 and a fixed or attached insert member 37, 41. During assembly, adjacent straight members 39, 39' are longitudinally aligned and attached together to form two end base members 38, 38', respectively.

During assembly, the base frame 33 is laid out on a flat ground surface. Optional stakes 130 may be extended through optional bores 48 formed on the straight members 35, 35', 39, 39' to connect the base frame 33 to the ground.

As shown in FIG. 2, in the preferred embodiment, the shelter 10 may be assembled over a flexible ground cover 99 that covers the ground inside the shelter 12. Optional rigid floor panels 109 may be placed over the ground cover 99 to provide a firm walking surface. An optional floor covering 111 may also be placed over the floor panels 109 to provide insulation.

As stated above, the important objective of the invention is to create a shelter 10 with straight side walls with a relatively high ceiling. This objective is met because each frame member 40 includes two opposite straight lower sections 42, 42', two curved eave sections 44, 44', and a central peak section 49. The straight lower section 42, 42' is a rectangular hollow tubular structure with two opposite end openings. The end is openings are designed to attach to the stub 46, 46' on the base frame 33. Attached to the upper end opening on each lower section 42, 42' is a narrow neck 47 that attaches to the adjacent curved eave section 44, 44'. The curved eave section 44, 44' includes a 45 degree curved section 45A and a straight section 45B. Formed on the lower end of the curved eave section 44, 44' is an upper narrow neck 47. During assembly, the neck 47 fits into the lower end opening formed on the adjacent straight section 42, 42'.

Disposed between the two roof sections 48, 48' is a central peak section 49. The ends of the central peak section 49 are open and designed to receive two necks 47 attached to the upper end on the two adjacent roof sections 48, 48' or to the eave section 44, 44'.

During assembly, the frame members 40 are first assembled on the ground. The frame members 40 are lifted and positioned transversally over the base frame 33 so that the lower end openings on the straight sections 35, 35' are aligned and registered over stubs 46, 46' formed on the side members 34, 34' respectively. When attached to the stubs 46, 46', the frame members 40 exert lateral pressure on the base frame 33 to securely hold them in place.

Purlins 60 are securely attached between two adjacent frame members 40 to hold them spaced apart. In one embodiment, the purlins 60 may include narrow necks (not shown) formed on their opposite ends that slip fit into holes (not shown) formed on the sides of the frame member 40 also shown in U.S. Pat. No. 6,679,009 and also incorporated by reference herein. Alternatively, the purlin 60 may include end openings that connect to pins that extend perpendicularly from the sides of the frame member 40. In the preferred embodiment, purlins 60 are extended between the eave sections 44, 44', between the straight sections 42, 42' and between the central peak sections 49.

The sections used on the frame member 40 and the base frame 33 are approximately 2×4 inches (width×length) or 2×3 inches in cross section. The straight sections 42, 42' are approximately 92 inches in length which provide approximately 120 inches of head room when standing next to the side wall. The optional straight roof sections 44, 44' are 48 to 96 inches in length depending on the size of the shelter 10.

Once the base frame 33 and the frame 12 are assembled, the main cover 70 is then pulled over the top surfaces of the frame members 40. The opposite longitudinal edges 70A, 70A' of the main cover 70 are connected to the side base members 34, 34' on the base frame 33 by hold down cables 72 that extend longitudinally along the side base members 34, 34'. The ends of the hold down cables 72 are attached to cleats (not shown) located on the outer surface of the side base members 34, 34' which are also disclosed in the U.S. Pat. No. 6,679,009 and incorporated by reference herein. Attached to the transverse edges of the main cover 70 are optional contour cables that connect to the two opposite end frame members 40.

The main cover 70 is made of polyester reinforced vinyl fabric and is sufficient in width and length to completely extend longitudinally and transversely over the frame 12. The main cover 70 may have a camouflaged exterior color that matches the environment. The main cover 70 may also include a blackout element (not shown) to prevent emission of light to the outside. Also attached to the outer surface of the main cover 70 are optional O-rings 56 shown in FIG. 5. Optional guide lines 63 may be attached to the O-ring 56 to support the inner liner 100. Alternatively, the optional guide lines 63 may be attached directly to the purlins 60.

End wall openings 89 are formed on the shelter 10 are covered by a complimentary-shaped end cover 90 made of the same material used to make the main cover 70. Attached to the outer edge of each end cover 90 is a contour cable 92. Formed on at least one end cover 90 is a door opening 95 with a flexible flap cover 97 (shown in a rolled-up position in FIG. 2). Hook and loop connectors (not shown) are provided around the door opening 95 that allows the flap 97 to be selectively opened or closed.

Also formed on the end cover 90 is at least one HVAC opening 160. The HVAC opening 160 includes two adjacent circular flap openings 162, 164 through which the inlet and outlet ports on a standard military issued HVAC (not shown) may extend when placed outside the assembled shelter 10.

Figure 6:
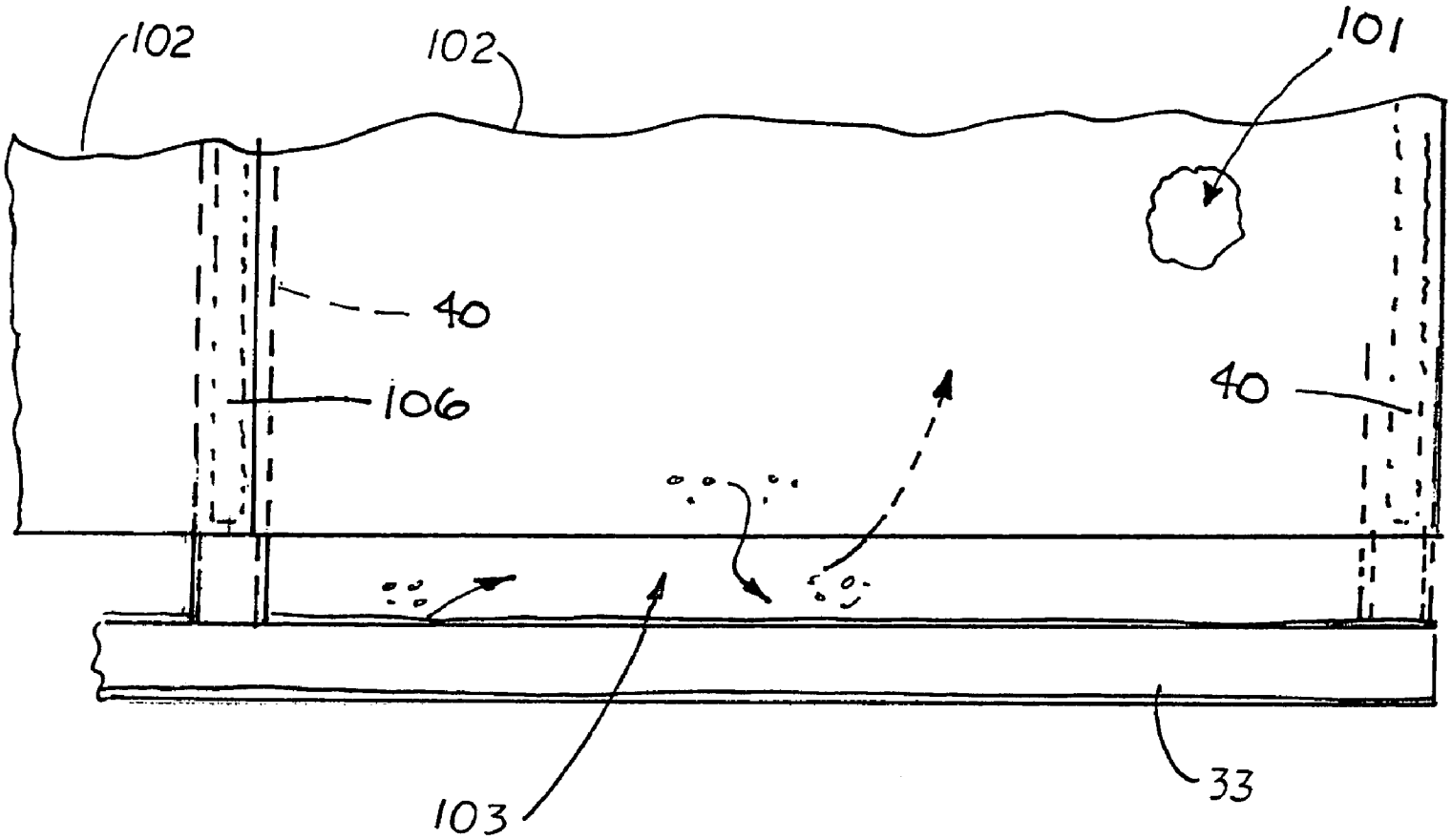
FIG. 6 is a partial side elevational view showing the gap formed between the lower edge of the inner lining and the base frame showing the movement of air located along the floor into the air wall space between frame members.
Figure 7:
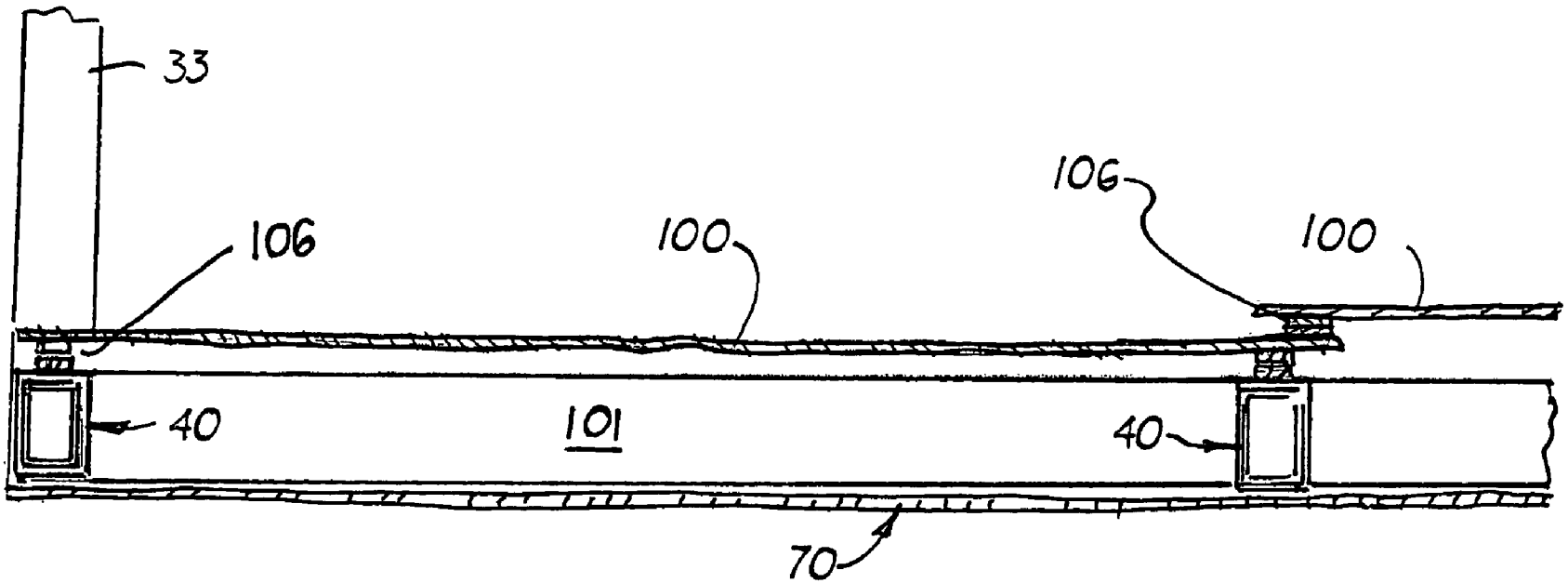
FIG. 7 is a sectional, top plan view taken along line 7-7 in FIG. 5.

As stated above and as shown in FIG. 3, an inner liner 100 acts as an insulation barrier and creates a lower living space 23 and a separate upper attic 24. The inner liner 100 also helps to increase air flow inside the shelter 12 by creating wall air spaces 101 between adjacent frame members 40. In the preferred embodiment, shown more clearly in FIGS. 6 and 7, the inner liner 100 comprises a plurality of narrow liner panels 102 that span transversely over the cavity formed between two adjacent frame members 40 thereby forming a wall air space 101. An optional gap 103 or vent is created along the lower edge of the inner liner 100 near the floor which allows air from the central area of the shelter to flow and circulate into the wall air space 101. In one embodiment, the inner liner 100 is made of a plurality of liner panels 102 which when assembled in an end to end manner from a large inner liner 100, are sufficient in length to extend upward from the side base member 34 to the opposite side base member 34', as shown in FIG. 3. In the preferred embodiment, the liner panels 102 are attached in an end-to-end manner with hook and loop connectors 105 located around their adjoining end edges. The adjacent side edges of the liner panels 102 overlap with the frame member 40 and are interconnected there to be releasable connectors, such as hook and loop connectors 106.

Figure 4:
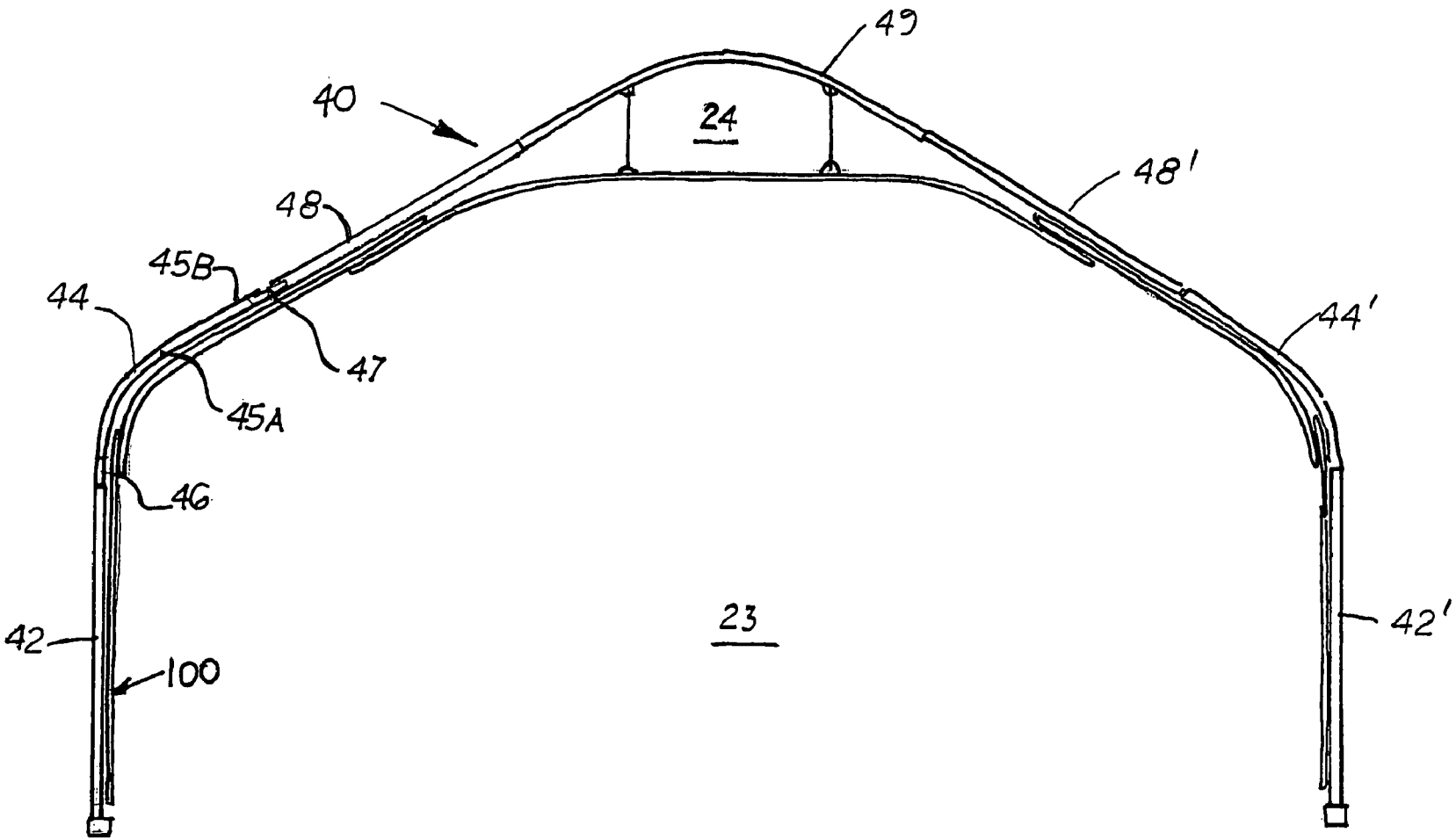
FIG. 4 is a sectional side elevational view of a frame member attached to the base frame.
Figure 5:
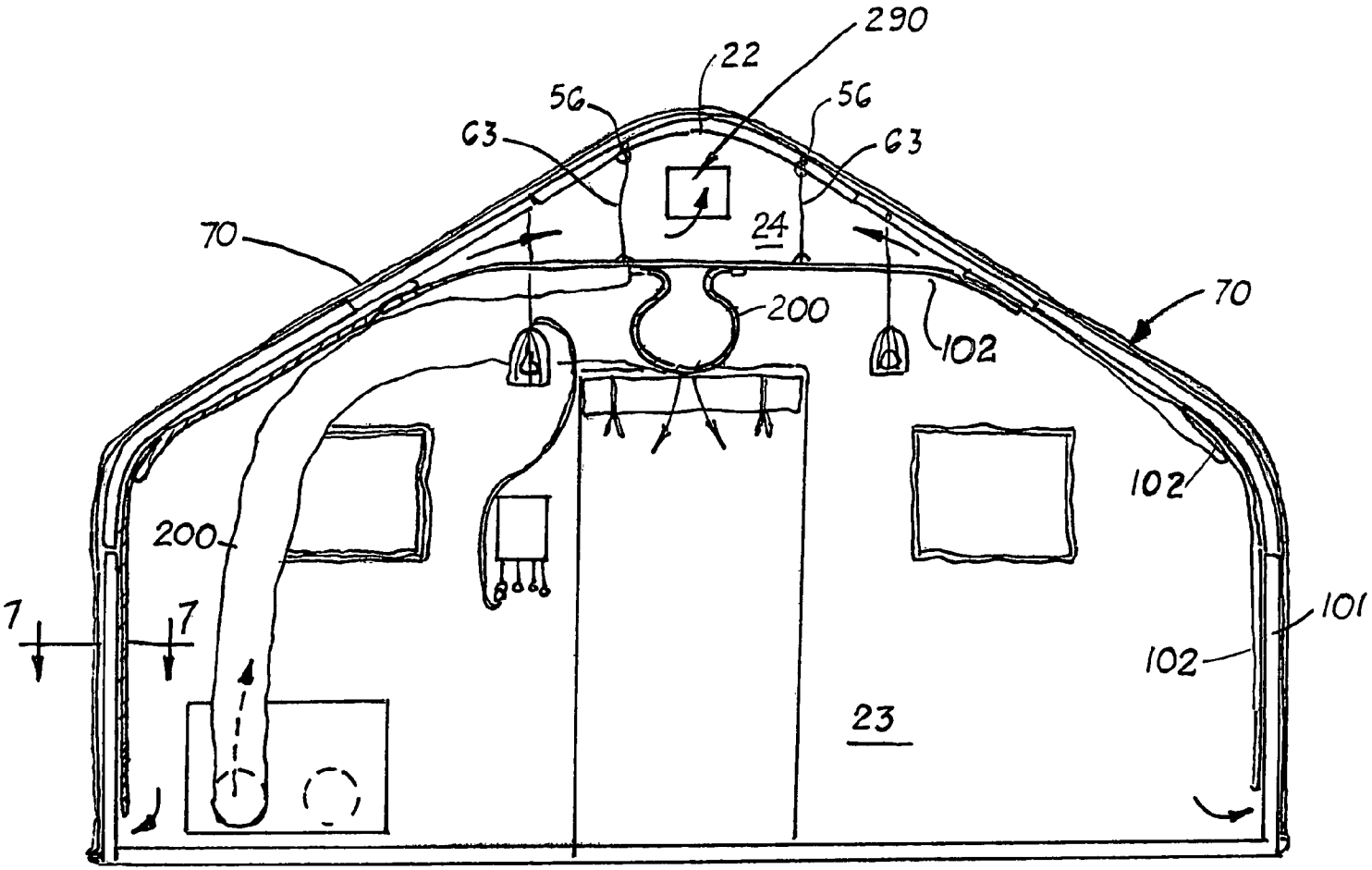
FIG. 5 is a side elevational view of the shelter showing the relative locations of the frame member, the base member, the outer cover, the inner liner, the end cover, an air duct and the creation of a main living area and an upper attic.
Figure 8:
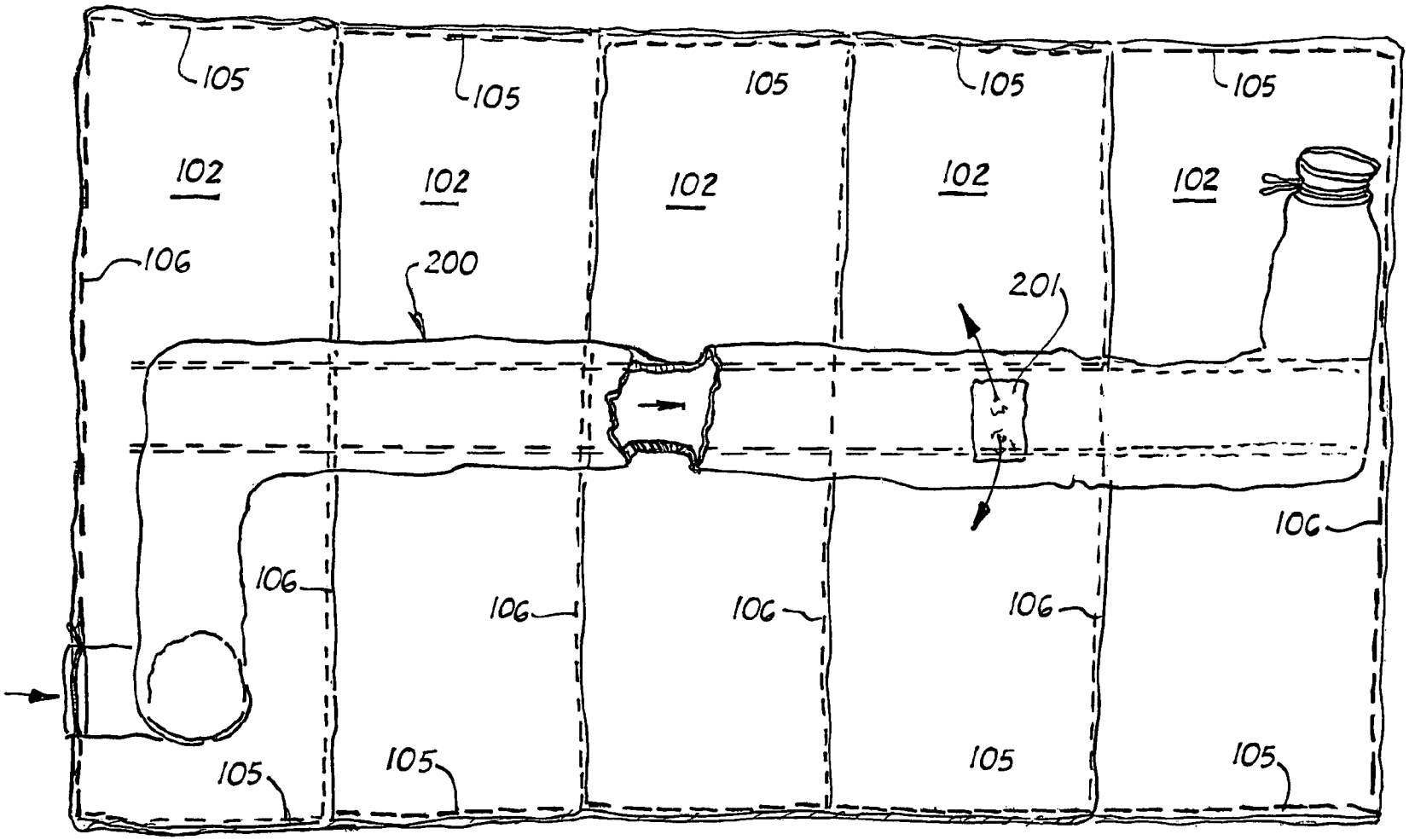
FIG. 8 is a bottom plan view of the inner liner attached to the inside surfaces of the frame members showing the relatively location of the air duct attached thereto.
Figure 9:
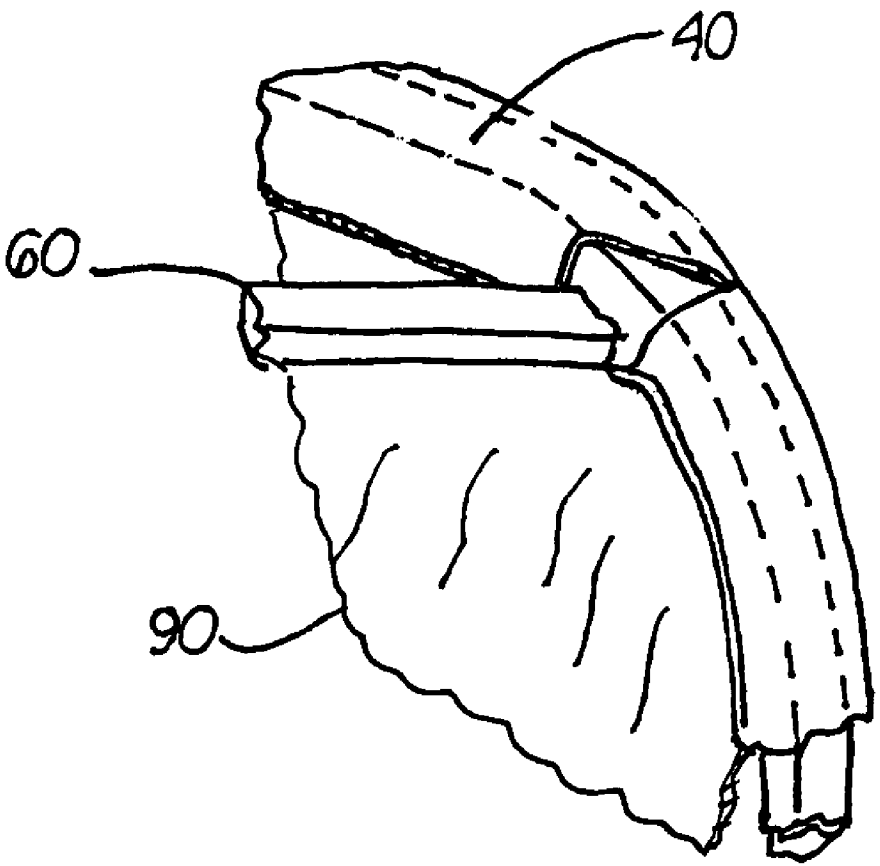
FIG. 9 is a perspective view of the end frame member showing the attachment of the end cover thereto.
Figure 10:
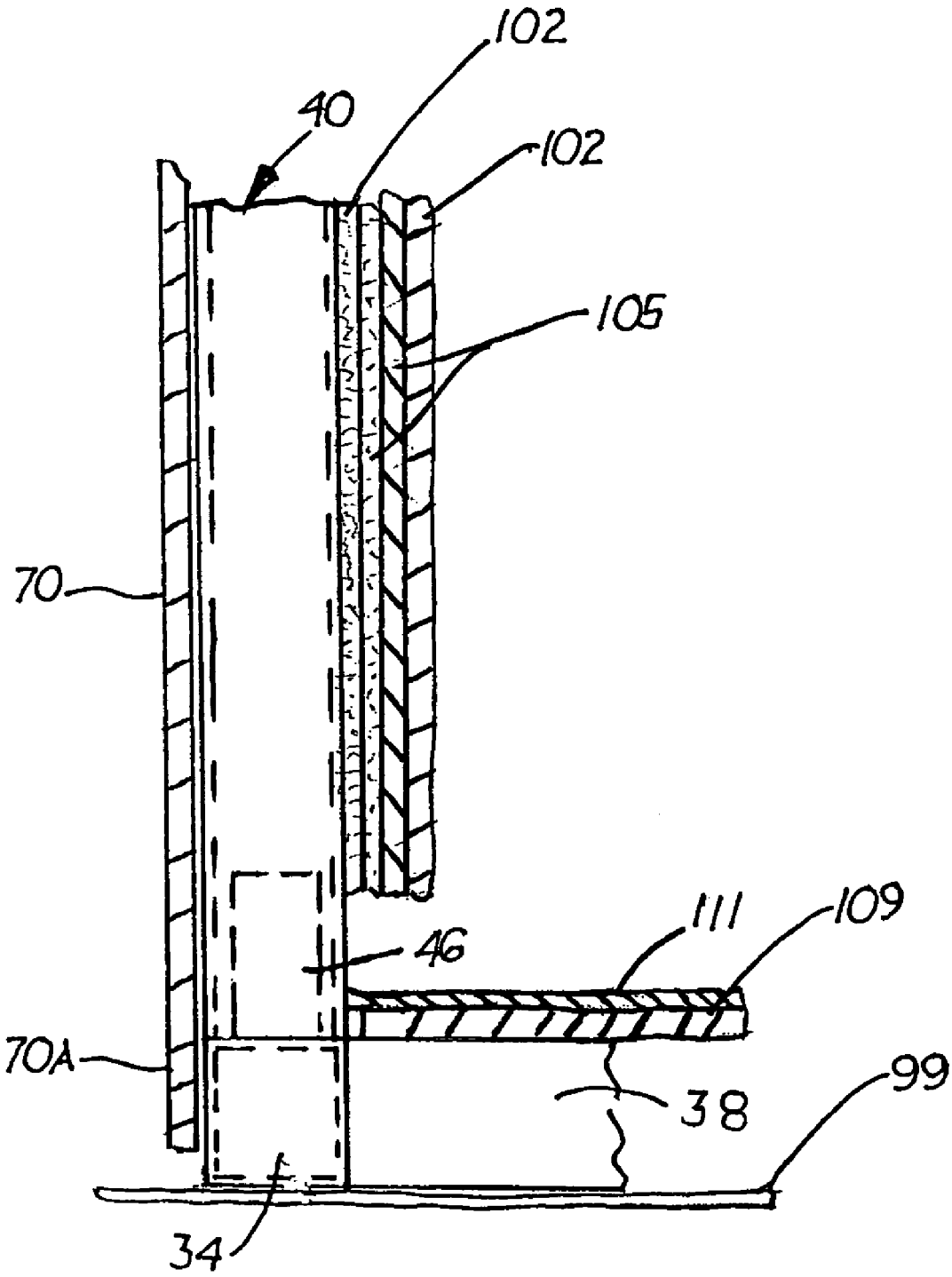
FIG. 10 is a partial sectional side elevational view of the side wall of the shelter.
Figure 11:
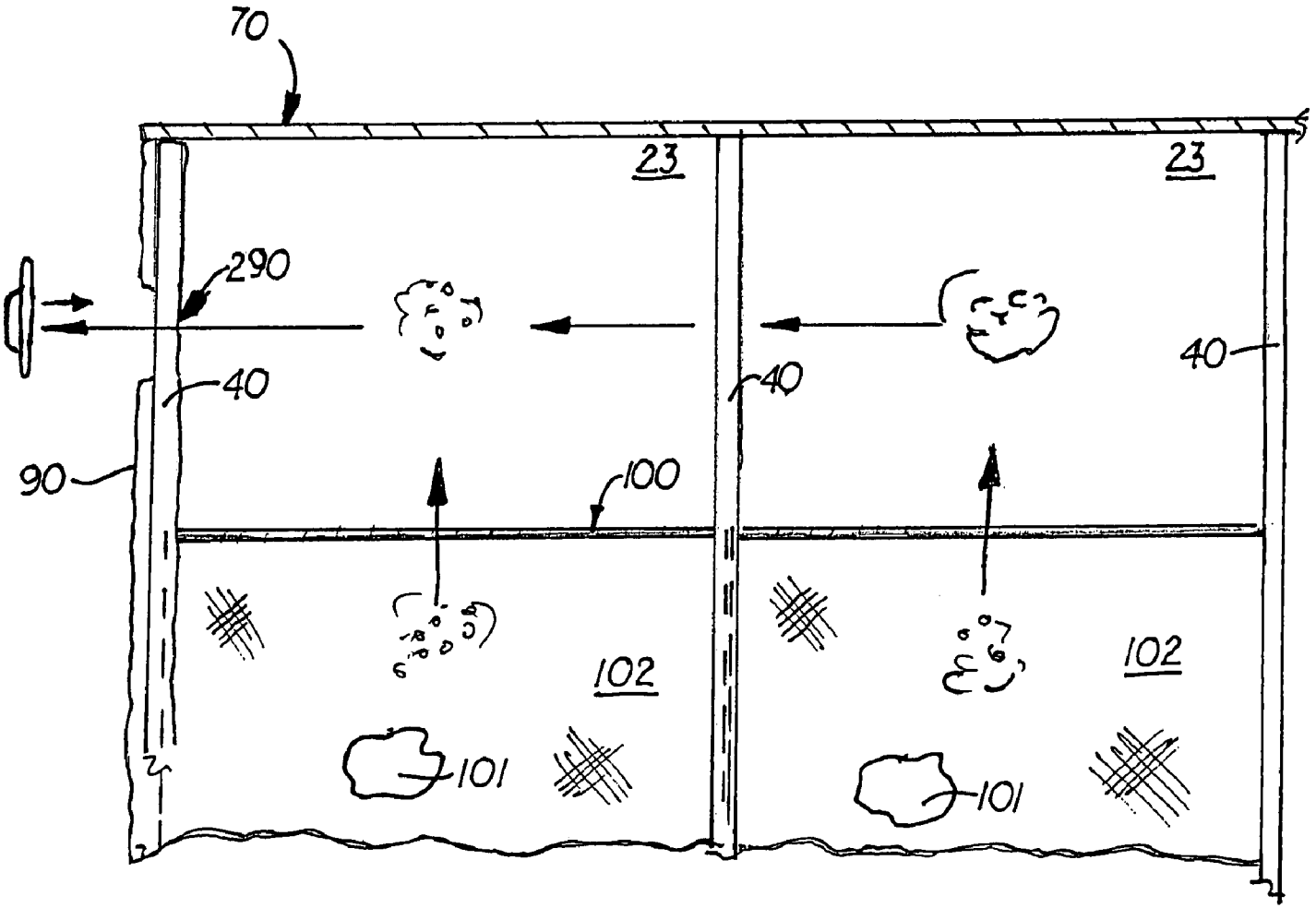
FIG. 11 is a sectional side elevational view of the shelter showing the flow of air from the wall air space into the attic.

When the liner panels 102 are properly positioned, a wall air space 101 is thereby created between the main cover 70 and the liner panel 102. As shown in FIGS. 4, 5 and 8, the middle section of the inner lining 100 extends horizontally across the shelter 10, thereby creating a large, attic space 24 above the center living space 23 of the shelter 10. In the first embodiment, a plurality of guide cables 29 extends downward from the curved section 49 to hold the middle section of the inner liner 100 upward and longitudinally aligned inside the shelter 12. The large attic 24 and wall air spaces 101 communicate and thereby provide continuous passageways for a circulating layer of air. As discussed below, closeable air vent openings 290 are formed in the end covers 90 that are located inside the attic 24 thereby allowing circulating air to escape into the outdoors.

The liner panels 102 are made of aluminized polyethylene and are sufficient in width to extend between the frame member 40. The liner panels 102 can be cut into equal lengths for easy transport and to form an elongated strip to extend transversally across the entire shelter 12. In the embodiment shown in the FIGS., the liner panels 102 are six millimeters thick and measure approximately 6 feet 6 inches×48 feet (width×length).

Located inside the shelter 12 is a flexible air sock 200 that connects at one end to the output port on the HVAC unit. The air sock 200 is made of a flexible flat material which when expanded with air forms a cylindrical structure and attaches to the end cover 90 and the inside surface of the inner lining 100. The air sock 200 extends upward along the end cover 90 and then extends longitudinally inside the shelter 12 just below the inner lining 100. Because the inner lining 100 forms a relatively high ceiling (approximately 8 to 10 ft in height) inside the shelter 12, the air sock 200 may extend downward from the inner lining 100 and not interfere with the shelter's 12 main living space 23. At least one vent 201 is formed along the air sock 200 through which air from the HVAC unit can be evenly dispersed inside the main living space 23. When the HVAC unit is activated, positive pressure is created inside the shelter 12 which causes inside air delivered by from the HVAC unit to travel downward from the vent 201, along the floor of the shelter 12, upward through the wall air spaces 101, and into the attic 24. Air in the attic 24 then flows through an open vent 290 formed on the end cover 90 to the outside environment.

Figure 12:
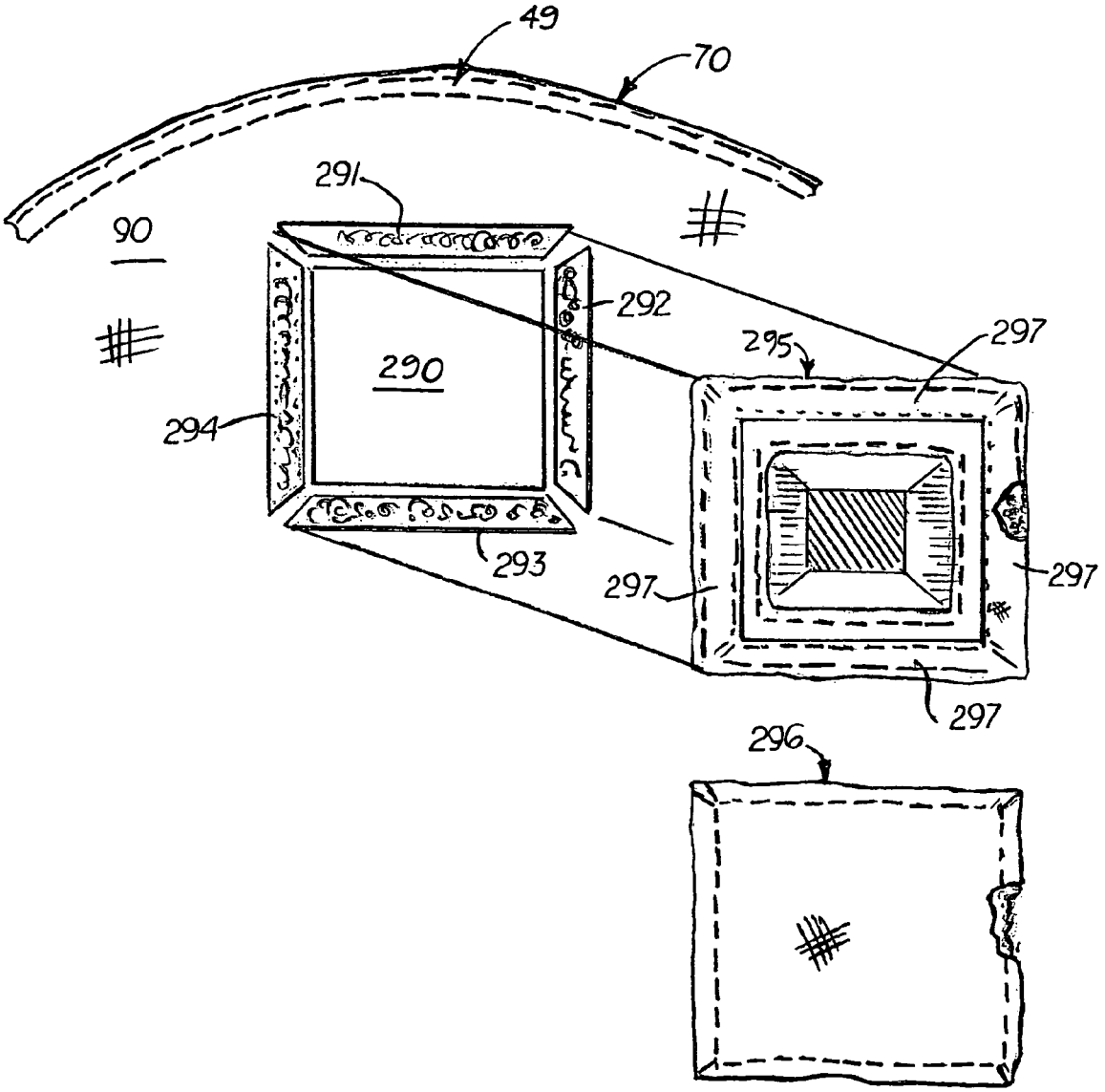
FIG. 12 is a rear elevational view of the upper section of the end cover showing the vent opening formed on the end cover, and either a rigid vent or a flexible cover being selectively attached over the vent opening.

FIG. 12 is a rear elevational view of the end cover 90 showing the vent opening 290 formed near the peak section 49. Attached securely around the vent opening 290 are four loop connecting strips 291-294. Disposed over the vent opening 290 is either a rigid vent cover 295 or a flexible vent cover 296. Both the rigid vent cover 295 and the flexible vent cover 296 includes hook connecting strips 297 designed to engage the loop connecting strips 291-294 on the end wall covers 90 to selectively attach the rigid vent cover 295 or flexible vent cover 296 thereto.

Figure 13:
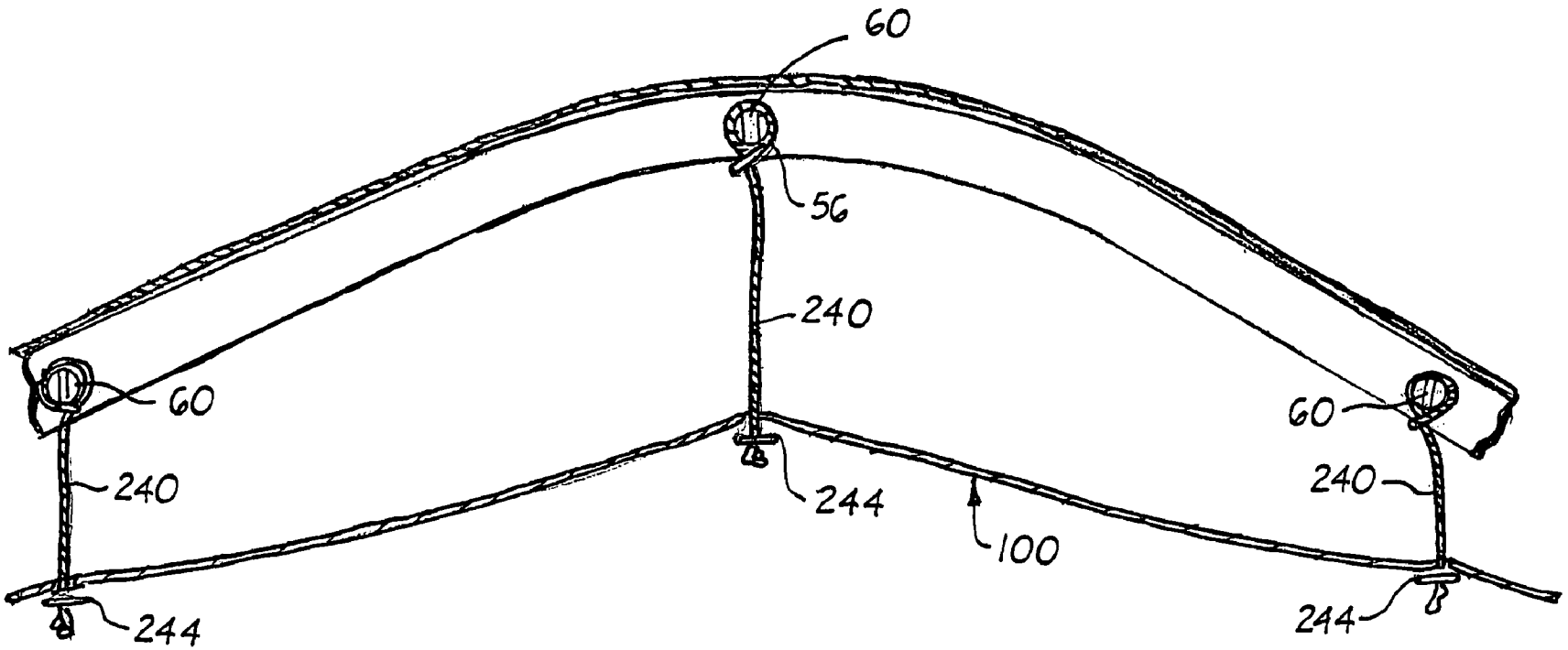
FIG. 13 is a sectional elevational view of the shelter showing the inner liner being suspended by guide lines that hang downward from purlins on the frame member.

As noted above, the inner liner 100 is suspended from the upper section of the frame member 40 thereby creating an upper attic 23. Alternatively, as shown in FIG. 13, the inner liner 100 may be suspended by guide lines 240 that wrap around the purlins 60 and extend downward. The lower end on the guide line 240 extends through a hole 242 formed in the inner liner 100. A large washer 244 is placed around the guide line 240 to hold the inner liner 100 in a suspended position.

Figure 14:
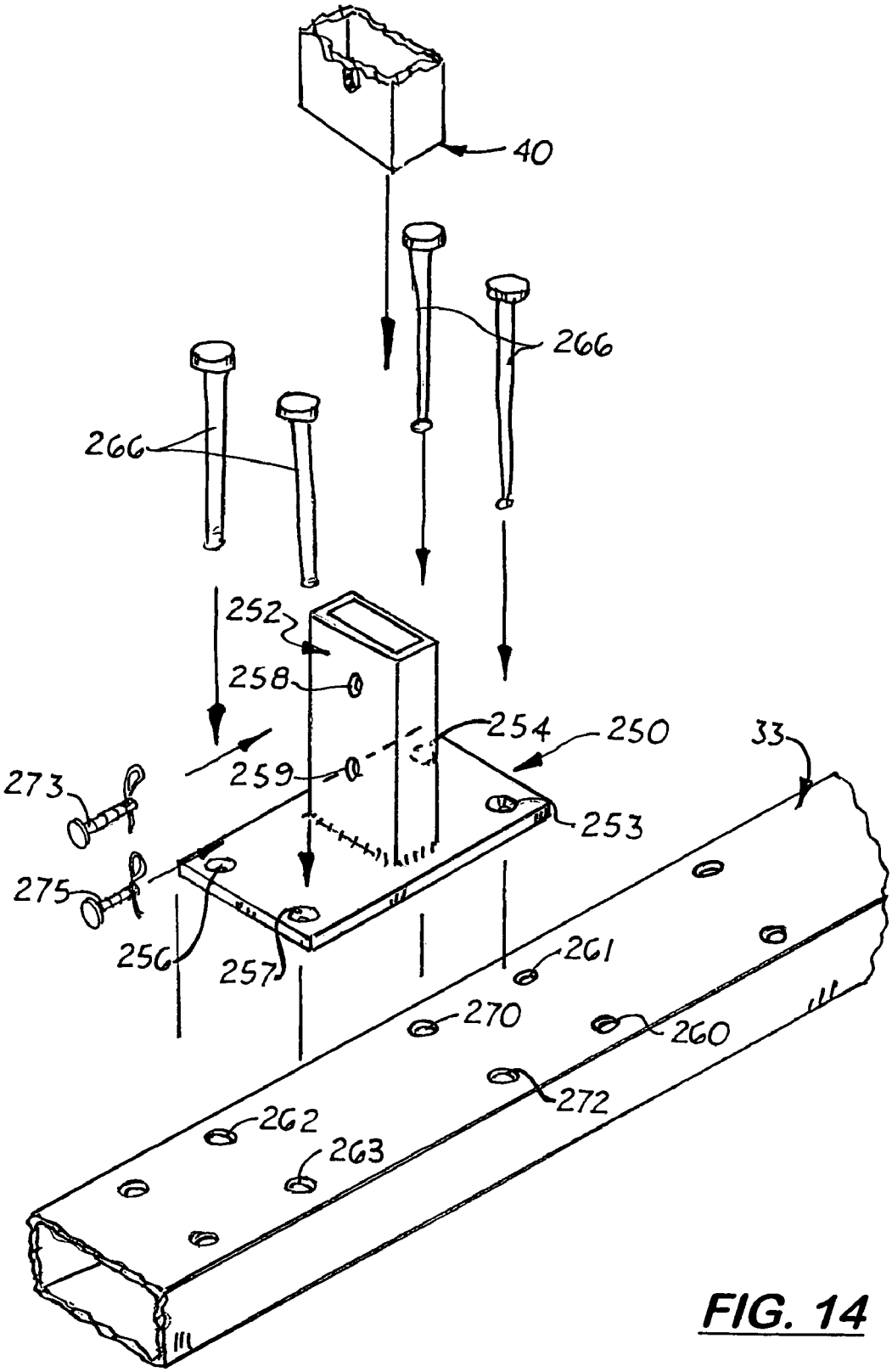
FIG. 14 is a perspective view of an optional adapter plate that is used to attach a frame member to the base frame.

FIG. 14 shows an optional adapter plate 250 used to attach the frame member 40 to the base frame 33. The adapter plate 250 includes a perpendicularly aligned stem 252 designed to fit inside the lower end of the adjacent frame member 40. The plate 250 includes four holes 254-257 which are aligned and registered over four holes 260-263 formed on the base frame 33. The base frame 33 includes a plurality of holes 264 that allow the plate 250 to be placed at different locations. Optional stakes 266 are used to attach the plate 250 to the base frame 33 and to attach the base frame 33 to the ground. The stem 252 includes two longitudinally aligned holes 258, 259 that are aligned and registered with holes 270, 272 on the end of the frame member 40. The cotter pins 273, 275 are inserted into the holes 258, 270 and 259, 272, respectively, to securely attach the frame member 40 to the stem 252.

Figure 15:
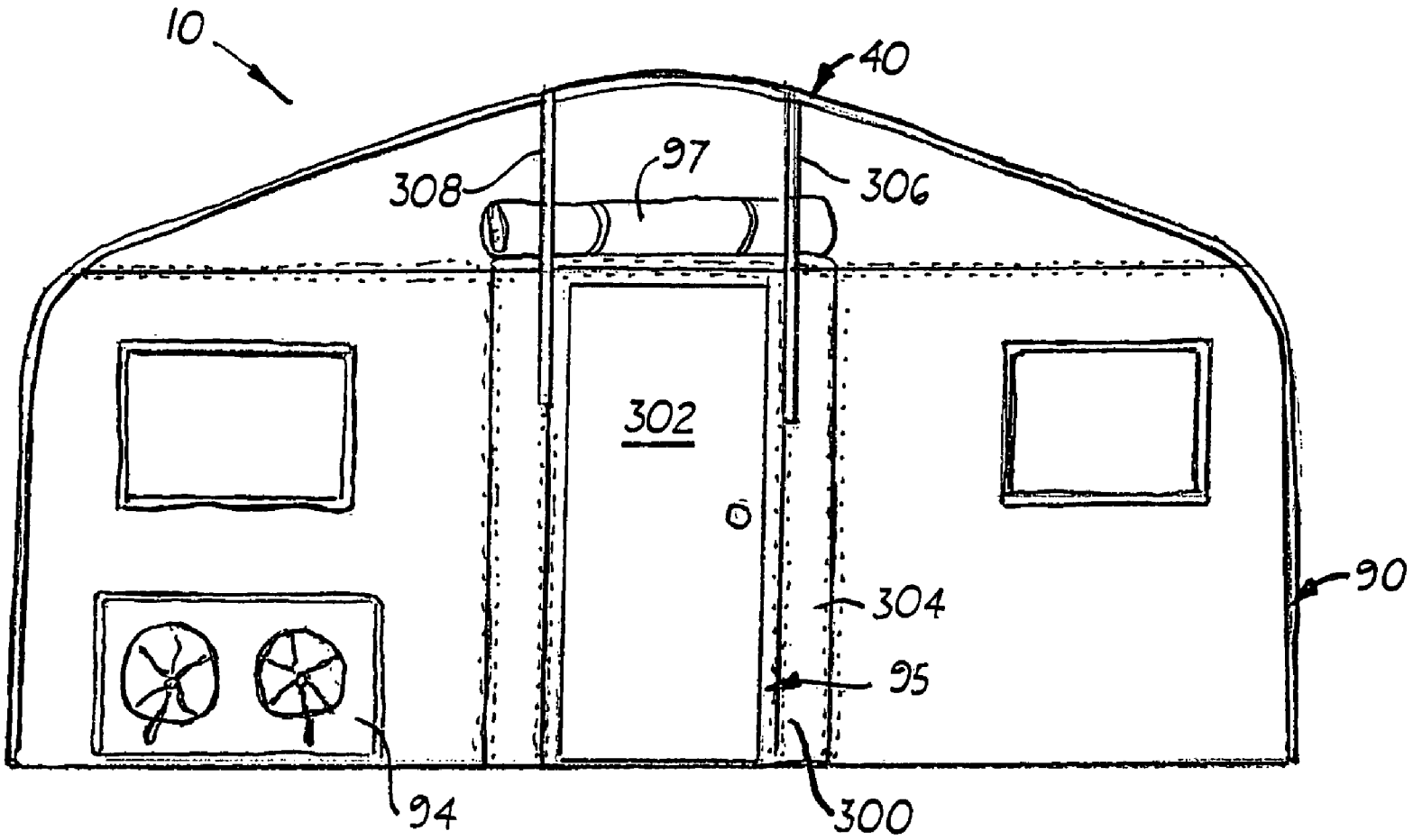
FIG. 15 is a side elevational view of the inside surface of the shelter showing an optional rigid door assembly mounted in the end cover.

FIG. 15 is an end elevational view of the end cover 90 of the shelter 10 showing a rigid door assembly 300 therein. The rigid door assembly 300 includes a rigid door 302 mounted inside a three-sided door frame 304. The door frame 304 is held in position by two vertical support bars 306, 308 that attach at one end to the end frame member 40. The lower ends of the door frame 304 are attached to the base frame 33. When a rigid door assembly 300 is used, the flexible flap cover 97 is rolled upward and out of the way.

The shelter 10 may include a wiring harness, an electrical fuse panel, and lighting and electrical outlet, similar to the structures shown in U.S. Pat. No. 6,679,009, which is incorporated herein by reference. The electrical fuse panel is designed to connect to a standard, military issued electrical power generator by use of a military/commercial plug adapter.

In the preferred embodiment, the shelter 10 measures 20 to 32 feet in length and 16 to 24 feet in width. The central peak section measures approximately 15 feet in height.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A portable shelter, comprising:

a. a base frame;

b. means for attaching said base frame to the ground;

c. at least two vertically aligned frame members spaced apart and aligned transversely over said base frame, each said frame member including two opposite straight sections, two curved eave sections and a central peak section;

d. means for selectively attaching the opposite ends of said frame member in a perpendicularly aligned position to said base frame;

e. at least one purlin extending between adjacent said frame member to hold them apart;

f. an end cover disposed over each said end frame member, at least one said end cover including at least one attic air vent, and at least one said end cover including a door opening enabling entry into said shelter;

g. a main cover disposed over said frame members when connected to said base frame to create an enclosed structure;

h. an inner liner located inside said shelter, said inner liner being sufficiently wide and long to form an enclosed wall space formed between said frame members and extend transversely inside said shelter to form a raised ceiling inside said shelter that creates a lower living space and an upper attic space inside said shelter;

i. means for attaching said inner liner to each said frame member, said inner liner having an inside surface; and, j. an elongated air sock longitudinally aligned inside said shelter and attached to said ceiling formed by said inner liner said elongated air sock being attached at one end to a HVAC unit and includes at least one outlet vent that enables air from said HVAC unit and travel through said outlet vent and into the living space of said shelter, flow upward through the wall spaces and into the attic, and then exit said shelter through said attic air vent on said end cover.

2. The portable shelter, as recited in claim 1, wherein said means for attaching said inner liner to said frame members is a plurality of hook and loop connectors attached to the adjoining edges of said inner liner and said frame member enabling said inner liner to be selectively attached thereto.

3. The portable shelter, as recited in claim 2, wherein said end panel includes a HVAC port opening through with the exhaust duct from said HVAC unit located outside and adjacent to said end cover.

4. The portable shelter, as recited in claim 2, further includes a plurality of guide lines attached to and extending downward from said frame member, the free end of each said guide line being connected to said inner lining to hold said inner liner in a suspended position inside said shelter.

5. The portable shelter, as recited in claim 1, wherein said end panel includes a HVAC port opening through with the exhaust duct from said HVAC unit located outside said end cover.

6. The portable shelter, as recited in claim 5, wherein said inner liner is made of a plurality of inner panels longitudinally aligned in an end to end manner and selectively connected together to form an elongated inner liner that transversely extends over said shelter.

7. The portable shelter, as recited in claim 6, wherein adjacent said inner panels are selectively attached together with loop and hoop connectors.

8. The portable shelter, as recited in claim 5, further includes a plurality of guide lines attached to and extending downward from said frame member, the free end of each said guide line being connected to said inner lining to hold said inner liner in a suspended position inside said shelter.

9. The portable shelter, as recited in claim 1, wherein said inner liner is made of a plurality of inner panels longitudinally aligned in an end to end manner and selectively connected together to form an elongated inner liner that transversely extends over said shelter.

10. The portable shelter, as recited in claim 1, further includes a plurality of guide lines attached to and extending downward from said frame member, the free end of said guide line being connected to said inner lining to hold said inner liner in a suspended position inside said shelter.

11. The portable shelter, as recited in claim 1, further including hook and loop connectors located between said air sock and said inner liner to attach said air sock to said inner liner.

12. The portable shelter as recited in claim 1, further including a door flap attached to said end cover and adjacent to said door opening, said door flap being capable of closing and opening said door opening.

13. The portable shelter as recited in claim 1, further including a rigid door frame attached to said end frame member, said rigid door frame including a rigid door located therein.

14. The portable shelter, as recited in claim 1, wherein said base frame includes perpendicularly aligned stubs attach to said frame members to hold said frame members in a vertical alignment over said base frame.

15. The portable shelter, as recited in claim 1, further including an adapter plate attached to said base frame, said adapter plate including a stub that attaches to said frame member and a plurality of holes that receive stakes to attach said adapter plate to said base frame.

* * * * *